US005546163A

United States Patent [19]

Asai et al.

[11] Patent Number: 5,546,163

[45] Date of Patent: Aug. 13, 1996

[54] IMAGE FORMING APPARATUS HAVING COUNTERS FOR COUNTING FREQUENCY OF USE OF PARTS

[75] Inventors: Hiroyuki Asai, Toyokawa; Kazuhiro Araki, Okazaki, both of Japan

[73] Assignee: Minolta Co., Ltd., Osaka, Japan

[21] Appl. No.: 310,780

[22] Filed: Sep. 27, 1994

[30] Foreign Application Priority Data

Sep. 30, 1993 [JP] Japan ..... 5-245157

[51] Int. Cl.[6] ..... G03G 21/00

[52] U.S. Cl. ..... 355/204; 355/208

[58] Field of Search ..... 355/200, 203, 355/204, 206, 208, 209, 205, 207, 308

[56] References Cited

U.S. PATENT DOCUMENTS

| | | | |
|---|---|---|---|
| 4,860,052 | 8/1989 | Ito et al. . | |
| 5,001,733 | 3/1991 | Negoro et al. | 355/308 X |
| 5,066,978 | 11/1991 | Watarai et al. | 355/206 |
| 5,196,884 | 3/1993 | Sugiyama et al. | 355/200 |
| 5,206,685 | 4/1993 | Hara et al. | 355/206 |

FOREIGN PATENT DOCUMENTS

| | | |
|---|---|---|
| 54-29643 | 3/1979 | Japan . |
| 61-88279 | 5/1986 | Japan . |
| 4-309195 | 10/1992 | Japan . |

*Primary Examiner*—Sandra L. Brase

*Attorney, Agent, or Firm*—Burns, Doane, Swecker & Mathis, L.L.P.

[57] ABSTRACT

An image forming apparatus having a process maintenance (PM) counter which counts the frequency of use of a part from the execution of maintenance of the part, and a life counter which counts the frequency of use of a part from when the part is replaced. The counting value of both counters are displayed selectively. The image forming apparatus has a reset switch which resets the PM counter when the counting value of the PM counter is displayed, and resets both the PM counter and the life counter simultaneously when the counting value of life counter is displayed, so as not to forget to reset the PM counter when the life counter is reset.

16 Claims, 8 Drawing Sheets

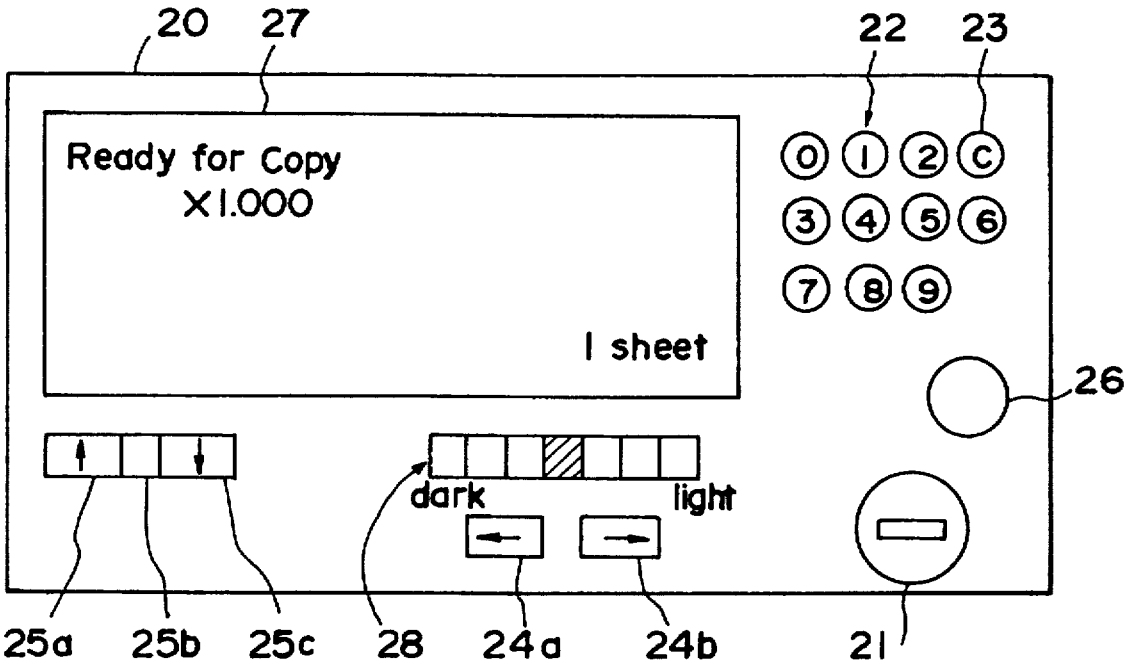
FIG.3
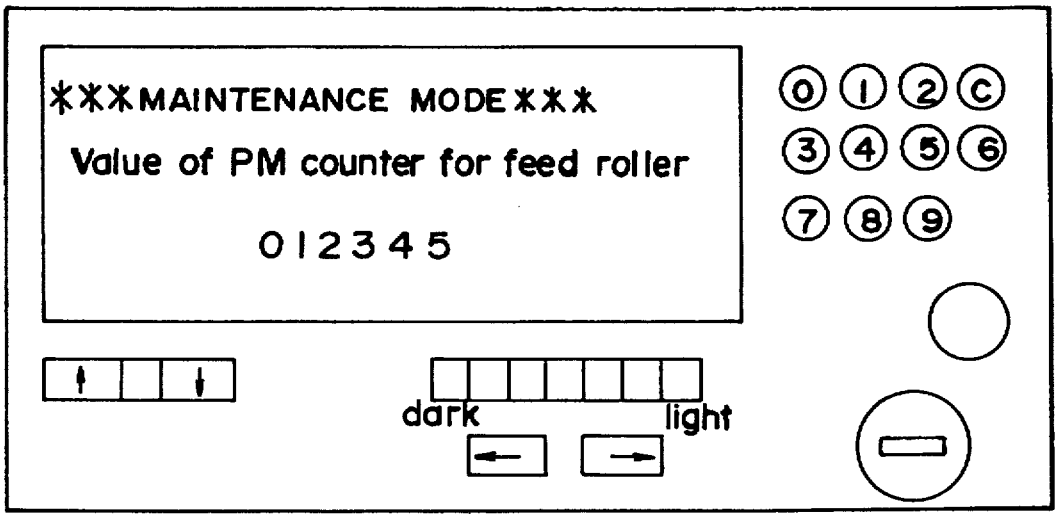

SW1
SW2
SW3
SW4
SW5
101
102
103
104
105
106
107
108
109
110
100
27
decoder
decoder
CPU
RAM
life counter
PM counter
total counter
display section

IMAGE FORMING APPARATUS HAVING COUNTERS FOR COUNTING FREQUENCY OF USE OF PARTS

BACKGROUND OF THE INVENTION

1. Field of the Invention

The present invention relates to an image forming apparatus, and more specifically relates to an image forming apparatus having counters for counting the frequency of use of parts.

2. Description of the Related Art

Conventional image forming apparatus are provided with various counters for counting the printing frequency and counting the frequency of use of various parts. For example, periodic maintenance such as cleaning and the like is necessary because feed rollers and the like become soiled by adhering paper particles and the like. Therefore, process maintenance counters (PM counters) are provided to alert the service personnel about the maintenance cycle. PM counters count the frequency of use of parts from the time the last maintenance was performed thereon, and the counter counts up with each image forming operation. When service personnel determine that maintenance is required because the PM counter count value has reached a predetermined value, the parts are cleaned. Then, the PM counter count value is returned to zero [0] to reset the PM counter for the next maintenance cycle. Parts which have been serviced several times and reached the end of their service life span must be replaced. Therefore, a service life counter is provided separately from the aforesaid PM counter so as to alert service personnel to the service life of the concerned part. The life counter is a counter for accumulating the frequency of use of parts attached to the body of the apparatus from the time the use of said parts begins, and continues to count the use of said parts throughout several maintenance cycles until said parts are replaced. When service personnel determine that parts replacement is required because the life counter count value has reached a predetermined value, the part is replaced. Then, the life counter count value is reset. In this instance, the PM counter must also be reset because the replacement part is a new part.

In the aforesaid apparatus, operational characteristics are inconvenient since service personnel must reset each counter at the time parts are replaced. Errors are generated when only the PM counter is reset and service personnel forget to reset the life counters. Thus, it is inconvenient to operate an apparatus having a plurality of counters when said counters must be reset.

SUMMARY OF THE INVENTION

A main object of the present invention is to provide, in an image forming apparatus, improved operational characteristics for resetting counters for counting the frequency of use of parts.

A further object of the present invention is to prevent service personnel from omitting to reset a particular counter when a plurality of counters must be reset.

A still further object of the present invention is to eliminate the labor of resetting each counter when service personnel must reset a plurality of counters.

These and other objects of the invention are achieved by providing an image forming apparatus comprising a first counter for counting frequency of use of a part included in the image forming apparatus, a second counter for counting frequency of use of the part, a first reset switch for resetting said first counter and a second reset switch for resetting said second counter, wherein said first reset switch resets only said first counter and said second reset switch resets also said first counter simultaneously with said second counter.

BRIEF DESCRIPTION OF THE DRAWING

In the following description, like parts are designated by like reference numbers throughout the several drawings.

FIG. 2 is a view of operation panel 20 of the copying apparatus shown in FIG. 1;

FIG. 3 is an illustration showing operation panel 20 when a PM counter value is displayed in LCD display 27;

DETAILED DESCRIPTION OF THE PREFERRED EMBODIMENTS

The preferred embodiments of the copying apparatus of the present invention are described hereinafter with reference to the accompanying drawings.

Figure 1:
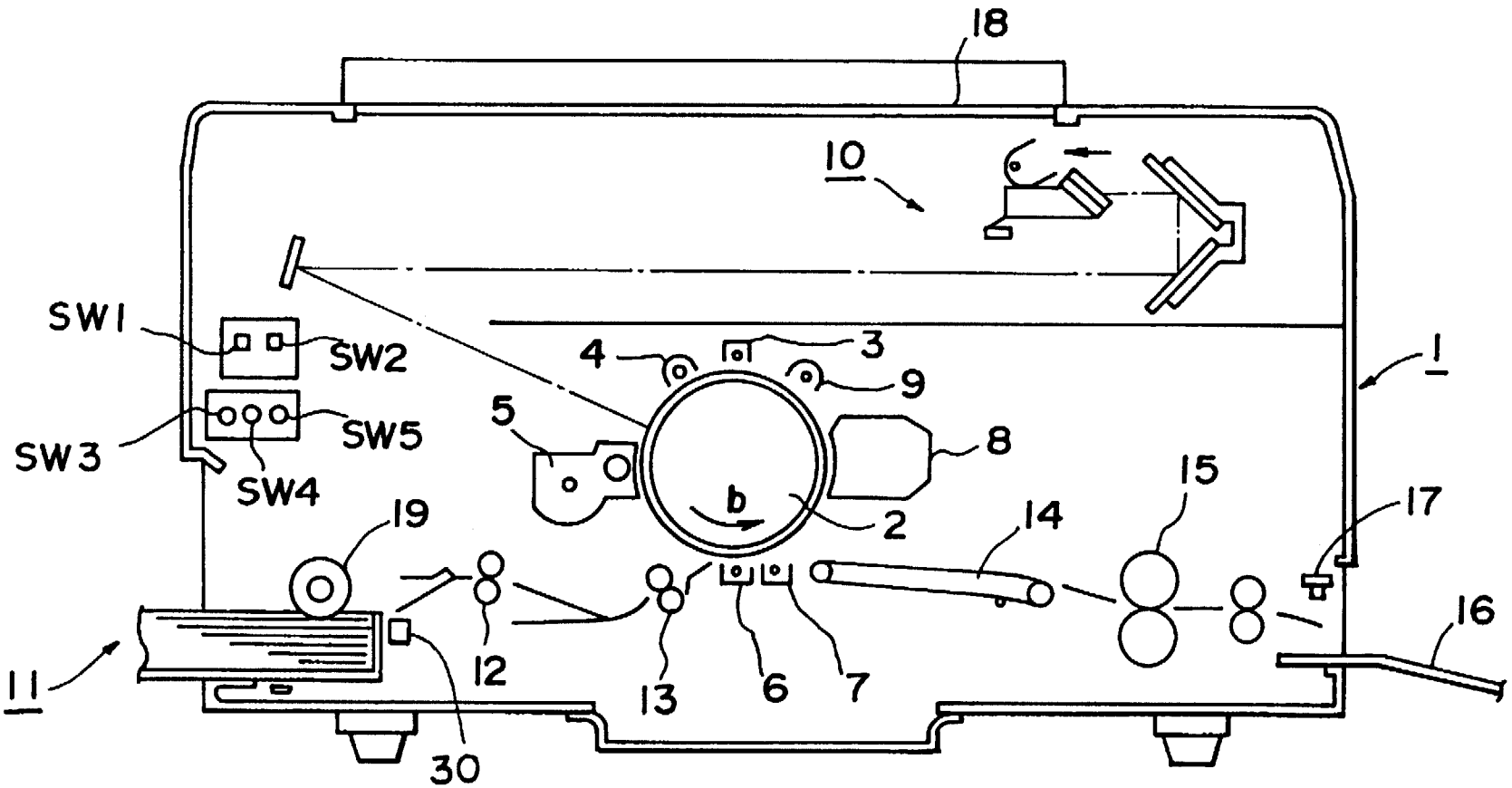
FIG. 1 is a section view of copying apparatus 1 of the present invention.

FIG. 1 is a section view of copying apparatus 1. As shown in the drawing, photosensitive drum 2 is provided centrally in copying apparatus 1 so as to be rotatable in the arrow [b] direction. Sequentially arranged around the periphery of photosensitive drum 2 are charger 3, image interval eraser 4, developing device 5, transfer charger 6, separation charger 7, cleaning device 8, and eraser lamp 9. Scanning optical unit 10 is provided at the top section of copying apparatus 1 for slit exposure of photosensitive drum 2 based on an image of an original document placed on document platen 18. Provided at the bottom section of copying apparatus 1 are cassette 11, feed roller 19, intermediate roller 12, timing rollers 13, transport belt 14, fixing rollers 15, and discharge tray 16. A copy sheet is fed to photosensitive drum 2, an image is formed on said copy sheet, and thereafter said copy sheet is discharged to discharge tray 16.

The image forming process accomplished by copying apparatus 1 is briefly described hereinafter.

Photosensitive drum 2 which has been charged by charger 3 is exposed to light via scanning optical unit 10 so as to form an electrostatic latent image on the surface of said drum 2, and said electrostatic latent image is developed by developing device 5 to produce a toner image. Copy sheets are fed via feed roller 19 one sheet at a time from cassette 11. On a downstream side of cassette 11, feed sensor 30 is provided which detects a fed sheet. Concretely, feed sensor 30 outputs ON signal in detecting the leading edge of a sheet. The signal is maintained ON state until the trailing edge of the sheet is detected by feed sensor 30, and becomes OFF state thereafter. The fed sheet is transported by intermediate roller 12, and is disposed at the area opposite transfer charger 6 and photosensitive drum 2 with a timing imparted by timing roller 13 so as to be received the transfer of the toner image, whereupon said copy sheet is separated from the surface of photosensitive drum 2 by separation charger 7. Thereafter, the copy sheet is transported by transport belt 14 and the transferred toner image is thermally fused to said copy sheet by fixing device 15, after which the copy sheet is discharged to discharge tray 16. Discharge sensor 17 for detecting the discharged sheet is provided at the discharge aperture disposed on the downstream side of fixing device 15. Just like feed sensor 30, discharge sensor 17 outputs ON signal in detecting the leading end of the sheet, and turns the signal to OFF in detecting the trailing edge of the sheet. A single copy operation is counted as completed each time a copy sheet discharge is detected by the output of the signal by the aforesaid discharge sensor 17. At this time, the total counter for counting the number of copy operations is incremented by one [1].

A cover which is openable (not shown in the illustration) is provided on the front side of copy apparatus 1. Keys SW1–SW5 are provided above feed device 11 and are operational when the aforesaid cover is open. Keys SW1–SW5 display and reset the values of the life counters for counting the service life of feed roller 19 or fixing roller 15 and the values of the PM counters for counting until the next maintenance session for both rollers.

FIG. 2 shows operation panel 20 provided on the top surface of copying apparatus 1. Operation panel 20 is provided with print key 21 for starting the copy operation, ten-key pad 22 for inputting numerical values 0–9, clear key 23 for clearing the number of copy sheets and the like, density up key **24*a* and density down key 24*b* for adjusting image density, magnification up key 25*a*, equal magnification key 25*b*, magnification down key 25*c* for changing the copy magnification, reset key 26 for resetting the copy conditions set via the aforesaid keys of the operation panel, LCD panel 27 for displaying messages of various kinds as well as copy conditions such as copy magnification and the like, and LED 28** for displaying copy density.

LCD panel 27 displays messages for guiding operations, copy number display, copy magnification display after power is switched ON. When feed roller counter display key SW1 is depressed to enter the maintenance mode for displaying the counter value relating to the feed roller, a message indicating that the maintenance mode is active is displayed on LCD 27. When life counter display key SW3 is depressed, the feed roller life counter value is displayed on LCD 27. Conversely, when PM counter display key SW4 is depressed instead of key SW3, the feed roller PM counter value is displayed on LCD 27.

FIG. 3 shows the mode of operation panel 20 when the feed roller PM counter value is shown on LCD 27.

When counter reset key SW5 is depressed while the counter value is being displayed as previously described, the displayed counter value is reset to zero. Similarly, when fixing roller counter display key SW2 is depressed instead of key SW1, the maintenance mode is set, and the fixing roller counter value can be displayed and reset by operating keys SW3–SW5.

Figure 4:
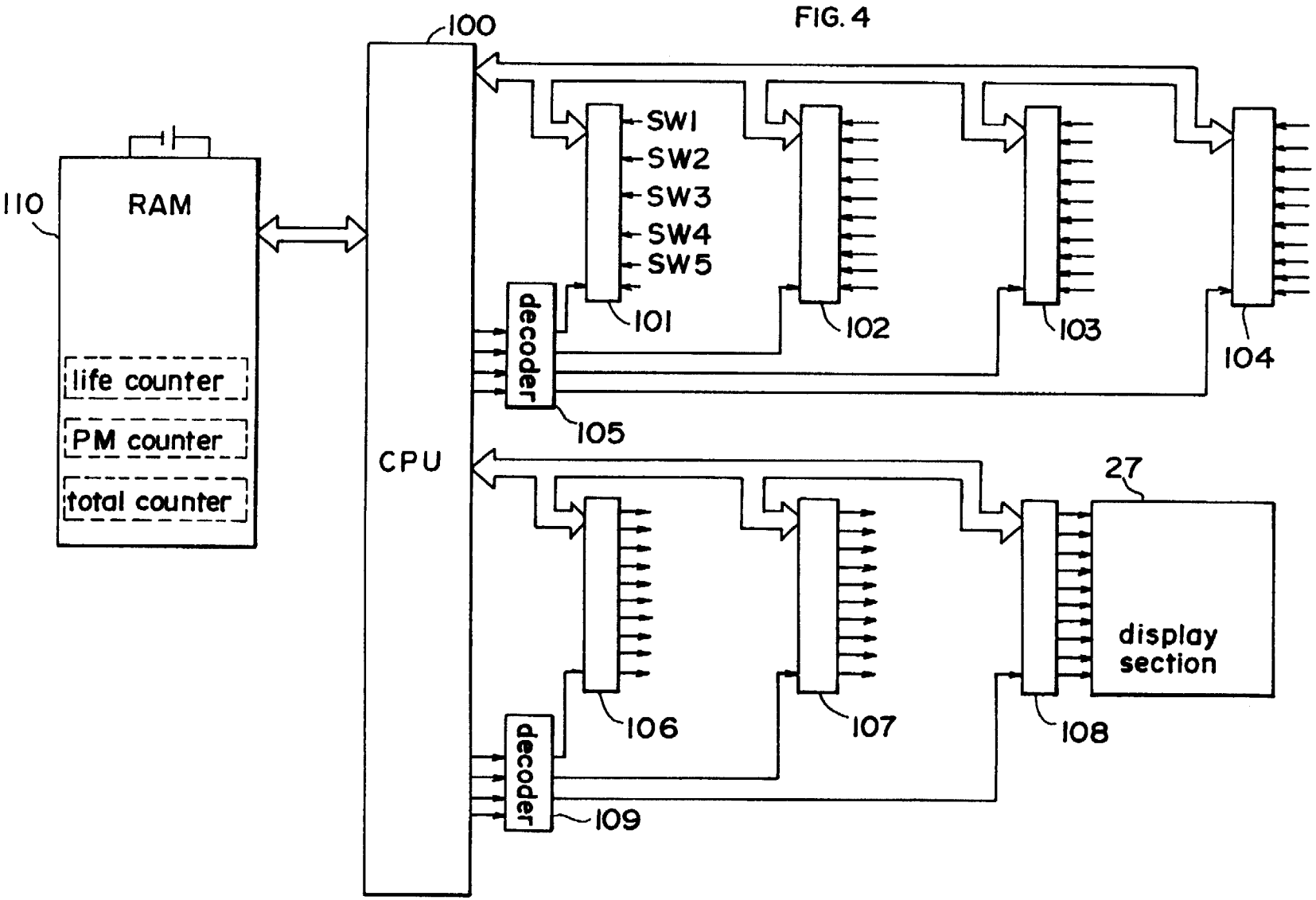
FIG. 4 is a circuit diagram of the control circuit of copying apparatus 1.

FIG. 4 is a circuit diagram showing the control circuit of copying apparatus 1. As shown in the drawing, the control circuit is constructed around a central processing unit (CPU) 100 to which are connected input IC101–104 via data lines. The previously described keys and sensors of various types are connected to the input pins of the IC101–104. IC101–104 are controlled by CPU100 connected thereto via decoder 105.

Output IC106–108 are connected to CPU100 via data lines. The previously mentioned LCD panel 27, and various drive sections including feed roller 19 and fixing roller 15 are connected to the output pins of IC106–108. IC106–108 are controlled via CPU100 connected thereto via decoder 109. On the other hand, RAM110 is connected to CPU100 as a memory, and is provided with battery backup power.

The previously described total counter, life counters and PM counters are provided over RAM 110 and controlled by CPU100. The life counters and PM counters are provided for feed roller 19 and fixing roller 15. A description of the feed roller counters follows hereinafter. The life counter and PM counter begin counting from the time the new feed roller is installed, and the values of both counters increment each time the feed roller is operated. The PM counter is reset by service personnel when maintenance has been performed on feed roller 19 so as to return the count value to zero; the PM counter is started again at this time. The fixing roller counters have identical operation.

In the present embodiment, the life counter and the PM counter for feed roller 19 count up one [1] each time the feed sensor 30 detects that a copy sheet is fed from the cassette 11 and outputs a signal, regarding feed roller 19 as having operated at this time. And the life counter and the PM counter for fixing roller 15 count up one [1] each time the discharge sensor 17 detects the discharge of a copy sheet and outputs a signal, regarding fixing roller 15 as having operated at this time.

However, the methods of detecting the operation of said feed roller and said fixing roller are optional. For example, both feeding roller and fixing roller may count up each time the discharge sensor 17 detects the discharge of a copy sheet. It is to be noted that, in such a case that the frequency of use of each roller could not be counted by the number of copy operation because, for example, a plurality of paper cassettes and feeding rollers corresponding thereto are provided, the operation of each roller should be detected separately.

Figure 5:
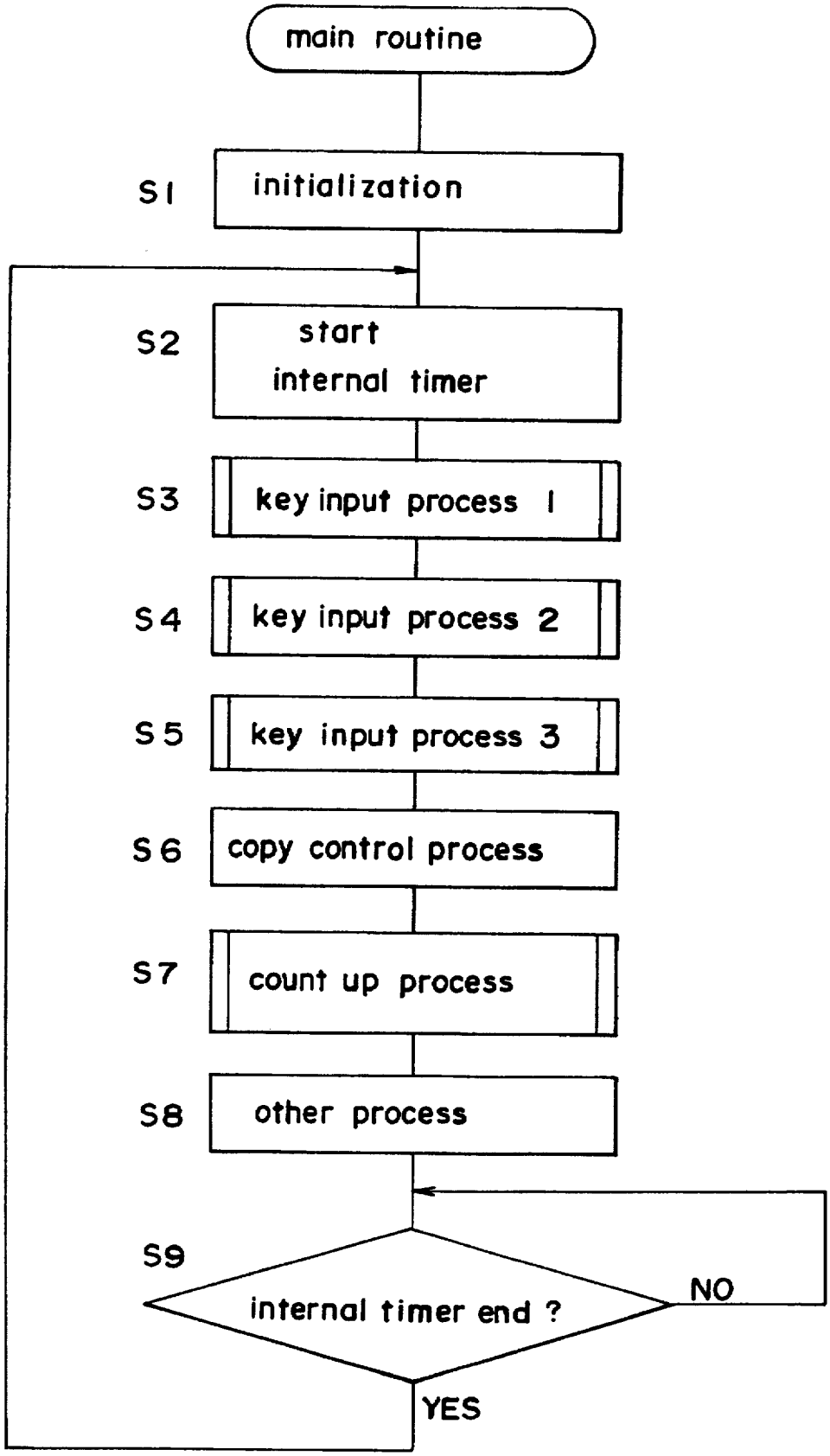
FIG. 5 is a flow chart showing the main routine of processes executed by CPU 100.

FIG. 5 is a flow chart showing the main routine of CPU100. Before describing the flow chart, the terms ON edge and OFF edge are defined hereinafter. ON edge describes the change in state that occurs when the state of a switch, sensor, signal or the like changes from the OFF state to the ON state. OFF edge describes the change in state that occurs when the state of a switch, sensor, signal or the like changes from the ON state to the OFF state.

As shown in FIG. 5, when power is supplied to copying apparatus 1, initialization process is executed in step S1 to initialize internal registers and internal memory of CPU100 and set the standard copy mode of the copying apparatus 1. Further, the values of flag [a] and variable X (described later) are also set at zero in step S1. RAM110 is not initialized because it stores the counter values.

In step S2, an internal timer is started which sets the time of the main routine. Subsequently, the following processes (described later) are sequentially executed: key input process routine (steps S3–S5), copy control process for controlling copy operations (step S6), and count up process routine (described later) (step S7). Thereafter, other processes are executed (step S8), the end of the internal timer is awaited (step S9), after which the process returns to step S2 and a loop is executed repeatedly.

Figure 6:
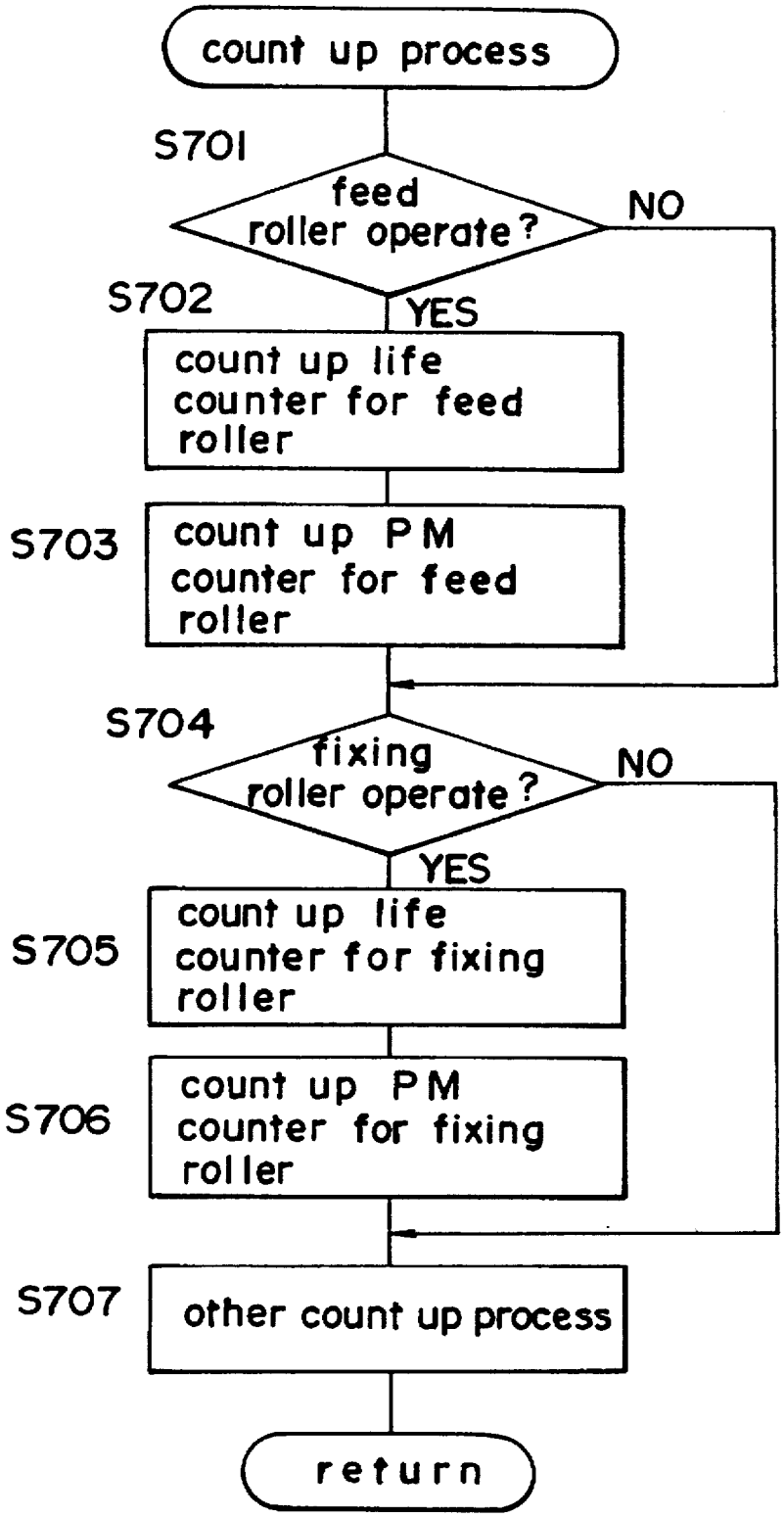
FIG. 6 is a flow chart showing the count up process.

FIG. 6 is a flow chart showing details of the count up process (step S7 of FIG. 5) for incrementing the counter value in accordance with copying operations. As shown in the drawing, in step S701, a determination is made as to whether or not feed roller 19 has been operated for copying. When feed roller 19 has been operated, the feed roller life counter and PM counter count up in steps S702 and S703, whereupon the process advances to step S704. When the feed roller has not been operated, the process advances directly to step S704.

In step S704, a determination is made as to whether or not fixing roller 15 has been operated for copying. When the fixing roller has been operated, the fixing roller life counter and PM counter count up in steps S705 and S706, whereupon the process advances to step S707. When the fixing roller has not been operated, the process advances directly to step S707.

In step S707, other count up processes are executed such as the count up of the total counter and the like. Thereafter, the process returns.

Figure 7:
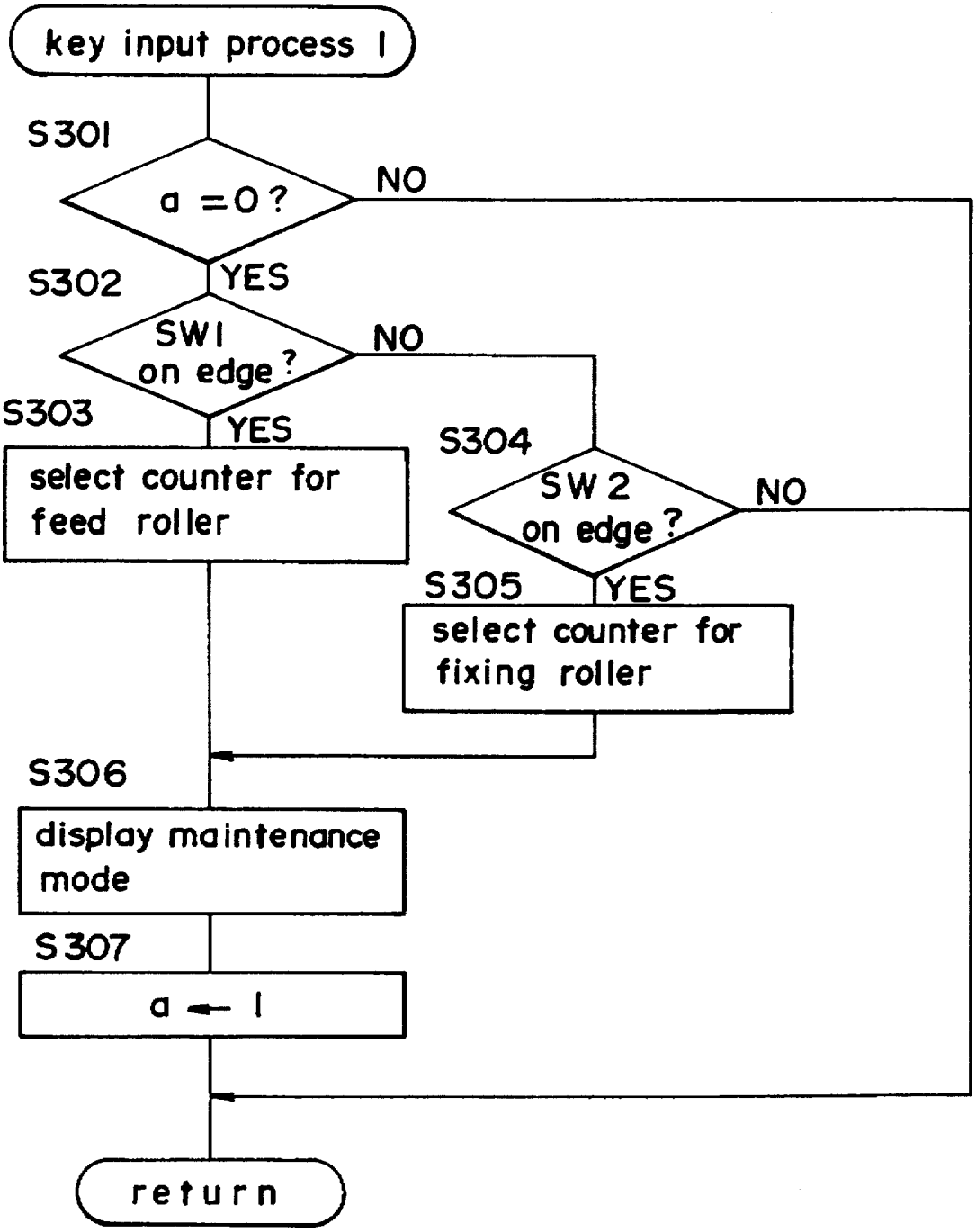
FIG. 7 is a flow chart of key input process 1.

FIG. 7 is a flow chart showing details of the key input process 1 (step S3 of FIG. 5) for determining whether or not the maintenance mode selection key has been depressed. As shown in the drawing, in step S301, the value of flag [a] is checked to determine whether or not the maintenance mode has been set. When the value of flag [a] is a value other than zero [0], it is determined that the maintenance mode has been set and the process returns directly. When the value of flag [a] is zero [0], it is determined that the maintenance mode has not been set, and the process advances to step S302.

In step S302, the maintenance mode is set with the feed roller counter key SW1 in the ON edge state, and in step S303 the feed roller counter value is read out from RAM110. When there is no key SW1 input, the process advances to step S304 and the maintenance mode is set with the fixing roller counter key SW2 in the ON edge state, and in step S305 the fixing roller counter value is read out from RAM110. When there is no key SW2 input, the process directly returns.

Subsequently, in step S306, a maintenance mode indicator is displayed on LCD display 27. In step S307, the process returns after the value of flag [a] is set at [1].

Figure 8:
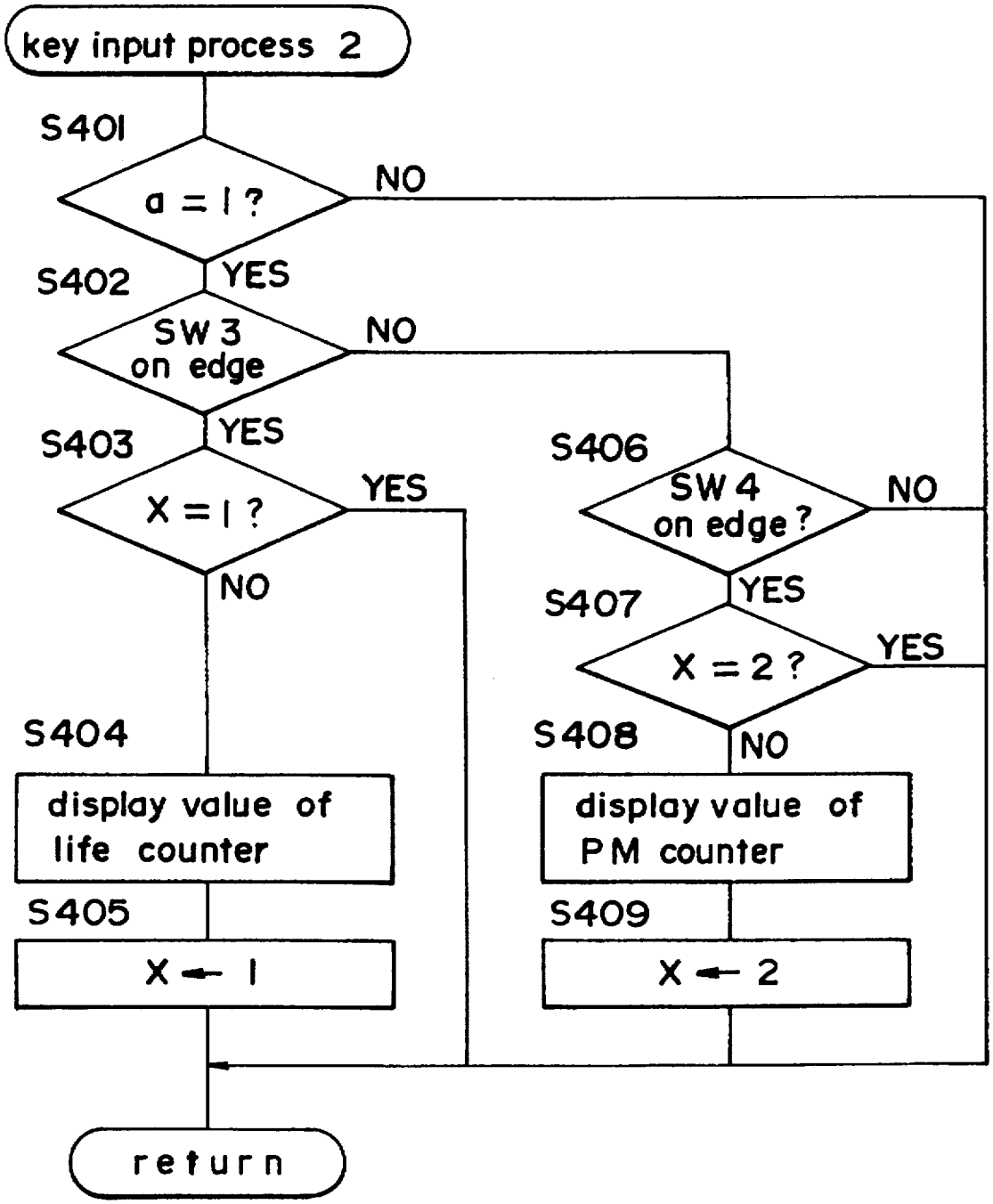
FIG. 8 is a flow chart of key input process 2.

FIG. 8 is a flow chart showing details of key input process 2 (step S4 of FIG. 5) for determining whether or not a counter has been selected. As shown in the drawing, the value of flag [a] is checked in step S401. When the value of flag [a] is a value other than [1], it is determined that the maintenance mode is not selected and the process directly returns. When the value of flag [a] is [1], it is determined that the maintenance mode has been selected, and the process advances to step S402, and the ON edge state of the life counter display key SW3 is detected.

In step S402, when key SW3 input is not detected, the process advances to step S406. When key SW3 input is detected, the process continues to step S403, and the value of variable X is checked to determine whether or not a counter value is displayed. When the value of variable X is [1], it is determined that a life counter value is being displayed, and the process returns directly. When the value of variable X is a value other than [1], it is determined that a life counter value is not being displayed, whereupon the life counter value read from RAM110 in the key input process 1 of FIG. 7 is displayed (step S404), the value of variable X is set at [1] in step S405, and thereafter the process returns.

In step S406, a determination is made as to whether or not the PM counter display key SW4 is in the ON edge state. When key SW4 input is not detected, the process returns directly. When key SW4 input is detected, the value of variable X is checked in step S407. When the value of variable X is [2], it is determined that the PM counter value is being displayed, and the process returns directly. When the value of variable X is a value other than [2], it is determined that the PM counter value is not being displayed, whereupon the PM counter value read from RAM110 in key input process 1 of FIG. 7 is displayed (step S408), the value of variable X is set at [2] in step S409, and the process returns.

Figure 9:
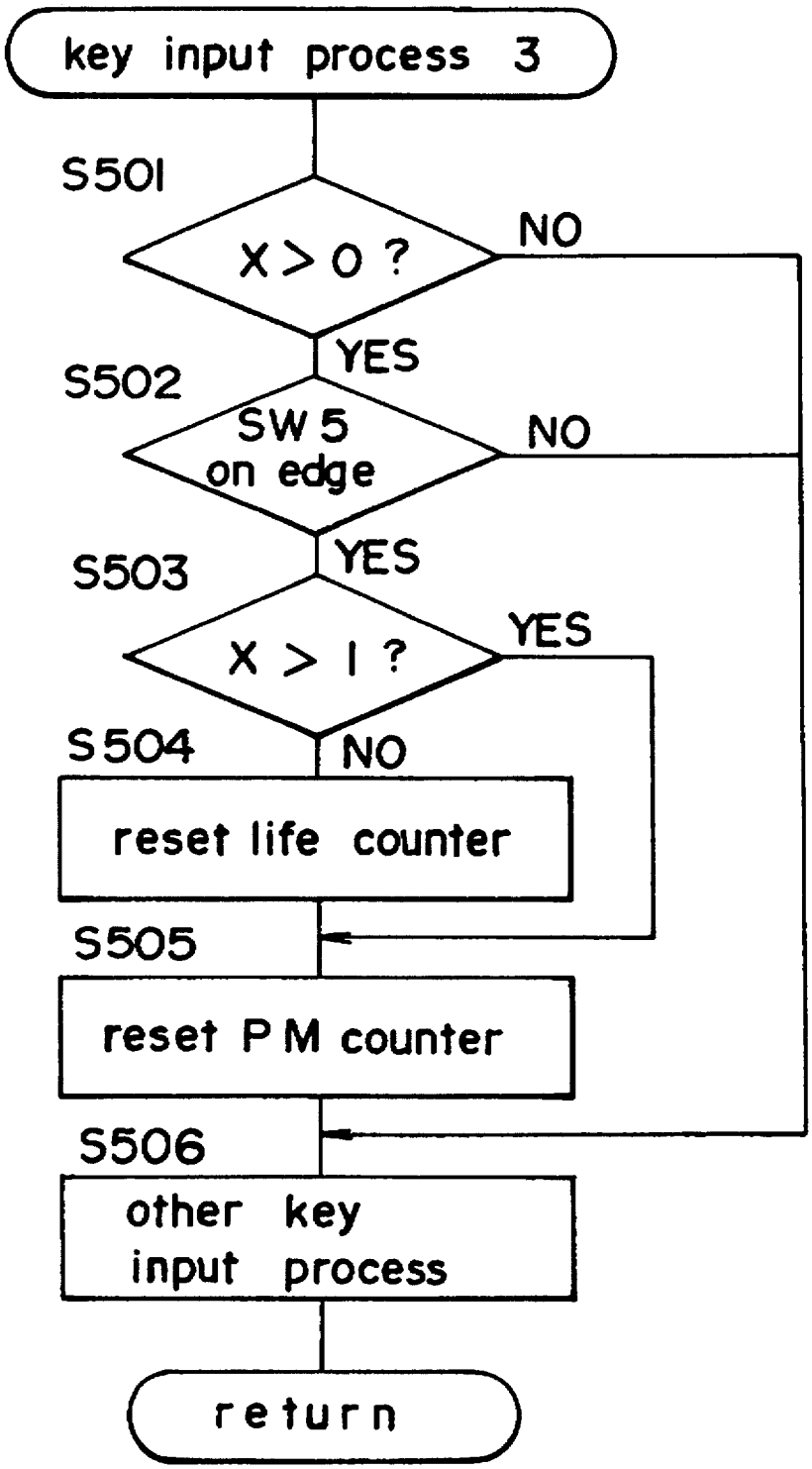
FIG. 9 is a flow chart of key input process 3.

FIG. 9 is a flow chart showing details of key input process 3 (step S5 of FIG. 5) for resetting counter values. As shown in the drawing, the value of variable X is checked in step S501. When the value of variable X is such that X>0, it is determined that the counter value is being displayed on LCD 27, and in step S502 it is determined that the counter reset key SW5 is ON edge. When the value of variable X is such that X is not greater than zero, it is determined that the counter value is not being displayed, and the process advances to step S506.

When key SW5 input is not detected in step S502, the process advances to step S506. When key SW5 input is detected and the value of variable X is [1], the life counter value and PM counter value are rest to [0] (steps S503–S505), whereas when the value of variable X is [2], only the PM counter is reset (steps S503 and S505). Thereafter, the process returns after other key input processes are executed in step S506. In step S506, the process for returning to the normal mode is executed when some key is operated on the operation panel, and the values of flag [a] and variable X are reset at zero [0]. Thus, in the present embodiment, because only the counter values displayed on LCD 27 are reset, errors such as resetting of the life counter are avoided when the PM counter value is displayed on LCD 27.

As previously described, the life counters count the frequency of use of the feed roller and fixing roller, and the PM counters count the frequency of use of both rollers since the previous maintenance session. Service personnel can reset the PM counter by resetting the life counter when replacing parts via keys SW1–SW5, as well as reset the PM counter alone when performing parts maintenance.

In the present embodiment, keys for displaying counter values and keys for resetting counters are provided separately from keys on operation panel 20. However, it is to be understood that counter value may be displayed and reset by operating keys on operation panel 20.

Although electronic type counters comprising CPU100 and RAM110 are used in the present embodiment, it is to be noted that the present invention is not limited to such counters inasmuch as counters of a mechanical type may alternatively be used. Any type of counter may be used insofar as said counter counts the frequency of use of parts. For example, the life counter for each part may be simultaneously reset when the total counter is reset in the present embodiment. Furthermore, a sensor may be provided at a position where each part is to be installed in the copying apparatus, and counters may be automatically reset in response to signal output of the sensor by installing replacement parts in the copying apparatus at the time of part replacement.

The present invention is not limited in application to the feed roller and fixing roller, and may be used with various types of parts such as, for example, the transport belt of an automatic document feeder (ADF) or the like.

It is further to be understood that the counting of frequency of use of parts by counters described in the present embodiment is not a limitation of the present invention inasmuch as the usage time period of said parts may alternatively be measured. For example, charge quantity data may be generated to control the amount of charge generated by a charger, light exposure data may be generated to control the amount of light exposure by an eraser lamp based on frequency of use, and said data may be reset in accordance with reset of said counters.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a detector which outputs a signal in response to operation of a part included in the image forming apparatus;

a first switch which outputs a first signal when operated;

a second switch which outputs a second signal when operated;

a first counter which increments each time the signal is output by said detector, and is reset in response to said first signal; and a second counter which increments each time the signal is output by said detector, and is reset in response to both said first signal and said second signal.

2. The image forming apparatus as claimed in claim 1, wherein said first or second switch is a sensor which is provided in the image forming apparatus, and outputs the first or second signal when the part is attached to the image forming apparatus.

3. The image forming apparatus as claimed in claim 1, wherein said first counter is a life counter which counts frequency of use of the part from when the part is replaced.

4. The image forming apparatus as claimed in claim 1, wherein said second counter is a process maintenance counter which counts frequency of use of the part from when the maintenance of the part is executed.

5. An image forming apparatus comprising:

a first counter for counting frequency of use of a part included in the image forming apparatus which increments for each use;

a second counter for counting frequency of use of the part which increments for each use;

a first reset switch for resetting said first counter; and a second reset switch for resetting said second counter, wherein said first reset switch resets only said first counter and said second reset switch resets both said first counter simultaneously with said second counter.

6. The image forming apparatus as claimed in claim 5 further comprising data generating means for generating data in response to count number of said first or second counter.

7. The image forming apparatus as claimed in claim 6 further comprising a display which displays the data generated by said data generating means.

8. The image forming apparatus as claimed in claim 7 further comprising a mode selecting switch which sets a mode to display the data generated by said data generating means.

9. The image forming apparatus as claimed in claim 5, wherein said first counter is a process maintenance counter which counts frequency of use of the part from when the maintenance of the part is executed.

10. The image forming apparatus as claimed in claim 5, wherein said second counter is a life counter which counts frequency of use of the part from when the part is replaced.

11. The image forming apparatus as claimed in claim 5 further comprising a sensor which outputs a signal in detecting attachment of the part to the apparatus, and the operations of said first and second reset switches being executed automatically when the signal is output by the sensor.

12. An image forming apparatus comprising:

a detector which outputs a signal in response to operation of a part included in the image forming apparatus;

a first counter which increments each time the signal is output by said detector;

a second counter which increments each time the signal is output by said detector;

a data generator which generates data in response to count numbers of said first and second counters;

a mode selector which selectively sets either one of a first mode for generating data about the count number of said first counter and a second mode for generating data about the count number of said second counter;

a reset switch which resets said first counter when the first mode is set by said mode selector, and resets both first and second counters simultaneously when the second mode is set by said mode selector.

13. The image forming apparatus as claimed in claim 12 further comprising a display which displays the data generated by said data generating means.

14. The image forming apparatus as claimed in claim 12, wherein said reset switch is a sensor which outputs a signal in detecting attachment of the part to the apparatus, so as to execute its reset operations in response to the signal output.

15. The image forming apparatus as claimed in claim 12, wherein said first counter is a process maintenance counter which counts frequency of use of the part from when a maintenance of the part is executed.

16. The image forming apparatus as claimed in claim 12, wherein said second counter is a life counter which counts frequency of use of the part from when the part is replaced.

* * * * *